US009056474B2

(12) United States Patent
Kobayashi

(10) Patent No.: US 9,056,474 B2
(45) Date of Patent: Jun. 16, 2015

(54) LIQUID EJECTING APPARATUS

(71) Applicant: SEIKO EPSON CORPORATION, Tokyo (JP)

(72) Inventor: Hiroyuki Kobayashi, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/225,585

(22) Filed: Mar. 26, 2014

(65) Prior Publication Data

US 2014/0292910 A1 Oct. 2, 2014

(30) Foreign Application Priority Data

Mar. 27, 2013 (JP) ..... 2013-067311

(51) Int. Cl.
*B41J 2/165* (2006.01)

(52) U.S. Cl.
CPC ..... *B41J 2/16508* (2013.01)

(58) Field of Classification Search
USPC ..... 347/29
See application file for complete search history.

(56) References Cited

U.S. PATENT DOCUMENTS

| | | | | |
|---|---|---|---|---|
| 6,398,337 | B1 * | 6/2002 | Wyble et al. | 347/30 |
| 6,540,323 | B1 * | 4/2003 | Dowell et al. | 347/29 |
| 7,798,597 | B2 | 9/2010 | Chikamoto | |

FOREIGN PATENT DOCUMENTS

| | | | |
|---|---|---|---|
| JP | 2003-326742 | A | 11/2003 |
| JP | 2008-200849 | A | 9/2008 |
| JP | 2009-132000 | A | 6/2009 |

* cited by examiner

*Primary Examiner* — Stephen Meier
*Assistant Examiner* — Alexander D Shenderov
(74) *Attorney, Agent, or Firm* — Maschoff Brennan

(57) ABSTRACT

A cap member has a fitting recess in which a liquid ejecting head is mounted. On inner surfaces of the fitting recess, a contact section configured to make contact with a side surface of the liquid ejecting head intersecting with a liquid ejecting surface is continuously provided along a circumferential direction of the fitting recess. A movement unit moves the cap member relative to the liquid ejecting head in a manner in which an area on the side surface of the liquid ejecting head with which the contact section makes contact is gradually increased when attaching the cap member to the liquid ejecting head.

18 Claims, 7 Drawing Sheets

LIQUID EJECTING APPARATUS

CROSS REFERENCES TO RELATED APPLICATIONS

This application claims priority to Japanese Patent Application No. 2013-067311 filed on Mar. 27, 2013. The entire disclosure of Japanese Patent Application No. 2013-067311 is hereby incorporated herein by reference.

BACKGROUND

1. Technical Field

The present invention relates to liquid ejecting apparatuses including a cap member for capping a liquid ejecting surface of a liquid ejecting head.

2. Related Art

As an example of a liquid ejecting apparatus, an ink jet recording apparatus including an ink jet recording head configured to eject ink droplets can be cited. As an ink jet recording head, there is provided such a recording head that includes a flow path member having an ink flow path such as a pressure generation chamber to which ink is supplied, and a nozzle plate which is bonded to the flow path member and in which a nozzle communicating with the pressure generation chamber is formed; the stated recording head ejects ink droplets through the nozzle by applying pressure to ink within the pressure generation chamber by, for example, driving a piezoelectric element or the like.

An ink jet recording apparatus, in general, includes a cap member for capping an ink ejecting surface (liquid ejecting surface) in which a nozzle of the ink jet recording head is opened. The cap member is a member that makes contact with part of the ink jet recording head to cap (perform capping on) the ink ejecting surface (the nozzle opened in the ink ejecting surface), and that is so provided as to be in contact with, for example, an outer circumference of the ink ejecting surface. As a cap member, for example, a member that is so configured as to make contact with an outer circumference side wall of a flow path member (flow path unit) formed in a step-like shape is disclosed (for example, see JP-A-2008-200849).

By causing the cap member to make contact with the ink jet recording head and capping the ink ejecting surface in the manner described above, it is possible to suppress ink in the vicinity of the nozzle from drying, thickening, and so on even if stand-by time exceeds a predetermined period of time, for example.

In the case where capping is performed by causing the above-mentioned cap member to make contact with the ink ejecting surface or the like, such stress is produced in the nozzle plate that causes the nozzle plate to deform in a direction toward the flow path member side during the capping operation. For example, even in the case where the cap member makes contact with the outer circumference side wall of the flow path member as described in JP-A-2008-200849, such stress is produced in the flow path member and the nozzle plate that causes deformation in a direction toward the flow path member side. Furthermore, there is a risk of occurrence of a problem that the nozzle plate is separated from the flow path member due to the stress produced during the capping operation.

The above problem is present not only in ink jet recording heads but also present similarly in liquid ejecting heads configured to eject liquid droplets other than ink droplets.

SUMMARY

An advantage of some aspects of the invention is to provide a liquid ejecting apparatus that is capable of suppressing a nozzle plate constituting a liquid ejecting head from being separated from a flow path member.

A liquid ejecting apparatus according to an aspect of the invention includes: a liquid ejecting head having a nozzle plate provided with a nozzle through which liquid is ejected; a cap member that is attached to the liquid ejecting head to cap a liquid ejecting surface in which the nozzle is opened; and a movement unit that relatively moves at least one of the cap member and the liquid ejecting head. In the stated liquid ejecting apparatus, the cap member includes a recess in which the liquid ejecting head is mounted; on inner surfaces of the recess, a contact section that makes contact with a side surface of the liquid ejecting head intersecting with the liquid ejecting surface is continuously provided along a circumferential direction of the recess. Further, the movement unit is so configured as to move the cap member relative to the liquid ejecting head in a manner in which an area on the side surface of the liquid ejecting head with which the contact section makes contact is gradually increased when attaching the cap member to the liquid ejecting head.

According to this aspect of the invention, since the contact section makes contact with the side surface of the liquid ejecting head when the cap member is attached to the liquid ejecting head, stress that is produced in the liquid ejecting head in a direction toward which the nozzle plate is separated is suppressed. Accordingly, separation of the nozzle plate due to the stress can be suppressed.

Here, in the case where the liquid ejecting surface is capped in a manner in which the contact section of the cap member makes contact with the side surface of the liquid ejecting head, it is necessary for an opening of the recess (opening formed in the contact section) of the cap member to be formed relatively small in order to make the contact section sufficiently adhere to the liquid ejecting head. This can raise a risk that friction resistance becomes large due to the contact section making contact with the liquid ejecting head when the cap member is attached to the liquid ejecting head. In other words, when the cap member is attached to the liquid ejecting head, there is a risk that a relatively large stress is produced in a direction in which the nozzle plate is deformed toward the flow path member side.

However, in the liquid ejecting apparatus of the invention, when the cap member is attached to the liquid ejecting head, the cap member is moved relative to the liquid ejecting head so that an area on the side surface of the liquid ejecting head with which the contact section makes contact is gradually increased. Through this, it is possible to smoothly attach the cap member to the liquid ejecting head. In addition, it is possible for the magnitude of stress produced in the liquid ejecting head can be made smaller when the cap member is attached to the liquid ejecting head. Accordingly, the separation of the nozzle plate due to the stress can be suppressed.

It is preferable that the movement unit be configured so that, when the cap member is attached to the liquid ejecting head, the liquid ejecting head is fitted in the recess of the cap member in a state in which the cap member is made to be slanted at a predetermined angle relative to the liquid ejecting surface and subsequently the cap member is so rotated as to be parallel with the liquid ejecting surface, for example. With this configuration, it is possible relatively easily to gradually increase the area on the side surface of the liquid ejecting head with which the contact section makes contact when the cap member is attached to the liquid ejecting head.

It is preferable that the movement unit having the above configuration be so configured as to move the cap member along the liquid ejecting surface in a state in which the liquid ejecting head is fitted in the recess of the cap member. In particular, it is preferable that the movement unit be so configured as to move the cap member along the liquid ejecting surface in a manner in which the cap member is stretched and extended while the cap member being in contact with the side surface at one side of the liquid ejecting head. Through this, it is possible to more smoothly attach the cap member to the liquid ejecting head and make the magnitude of stress produced in the nozzle plate be further smaller.

It is preferable that the contact section include a slope portion that is sloped with respect to a bottom surface of the cap member. Further, it is preferable that the contact section include the slope portions on the respective inner surfaces configuring the recess of the cap member and the stated slope portions be formed in a mountain shape projecting toward the opening side of the recess. With this configuration, when the cap member is attached to the liquid ejecting head, it is possible further easily to gradually increase the area on the side surface of the liquid ejecting head with which the contact section makes contact.

It is preferable that the movement unit release the stretching and extending of the cap member after the liquid ejecting head has been inserted into the cap member.

It is preferable that the movement unit include a pair of coupling members coupled to the cap member in a rotatable manner and an elevating movement unit configured to raise/lower the coupling members separately.

It is preferable that the movement unit attach the cap member to the liquid ejecting head by moving the liquid ejecting head.

It is preferable that the liquid ejecting head include the nozzle plate provided with the nozzle and a fixing member fixed with the nozzle plate; the fixing member include an opening portion for opening the nozzle and side walls that are continuously provided along the circumference of the opening portion; and the movement unit attach the cap member to the liquid ejecting head by causing the contact section to make contact with the side wall.

A method according to an aspect of the invention is a method of attaching a cap member to a liquid ejecting head of a liquid ejecting apparatus that includes a movement unit and may include: causing a contact section of the cap member to make contact with a side surface of the liquid ejecting head by relatively moving at least one of the cap member and the liquid ejecting head using the movement unit; gradually increasing an area where the contact is made by relatively moving at least one of the cap member and the liquid ejecting head using the movement unit; and attaching the cap member to the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the invention will be described with reference to the drawings.

First Embodiment

Figure 1:
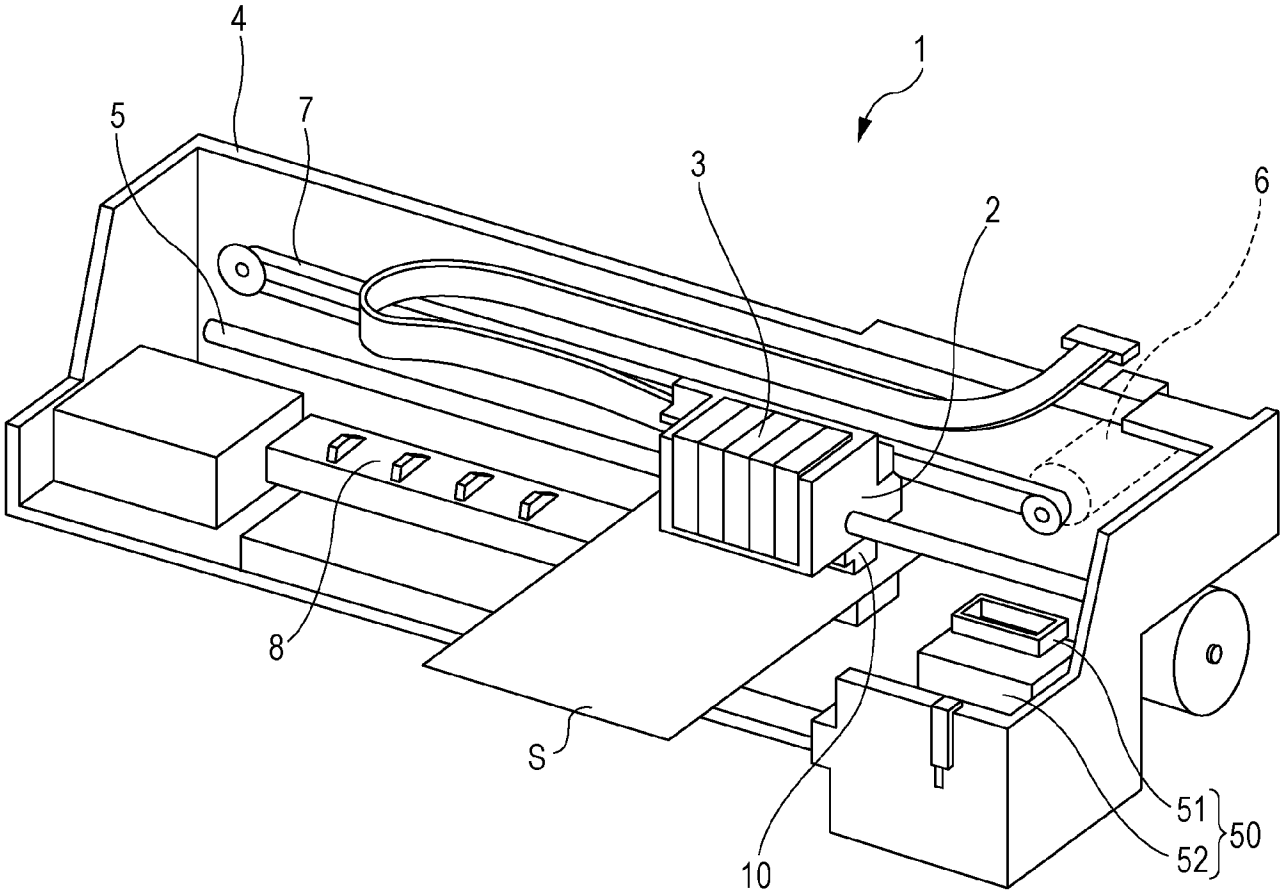
FIG. 1 is a schematic perspective view of a recording apparatus according to a first embodiment of the invention.

As shown in FIG. 1, an ink jet recording apparatus (hereinafter, referred to as a "recording apparatus") 1 includes a carriage 2 on which a plurality of ink cartridges (liquid storage units) 3 respectively storing different color inks and an ink jet recording head (hereinafter, referred to as a "recording head") 10 are mounted. Each ink cartridge 3 is connected to the recording head 10 and is so configured as to supply each individual color ink to the recording head 10.

The carriage 2 is provided on a carriage shaft 5 installed in an apparatus main body 4 in a movable manner along a shaft direction (scanning direction). The carriage 2 is moved along the carriage shaft 5 by the driving force of a drive motor 6 which is transmitted to the carriage 2 via a plurality of gears (not shown) and a timing belt 7. Meanwhile, a platen 8 is provided along the carriage shaft 5 in the apparatus main body 4, and a recording target medium S (ejection target medium) such as paper fed by a paper feed device (not shown) or the like is transported on the platen 8.

Figure 2:
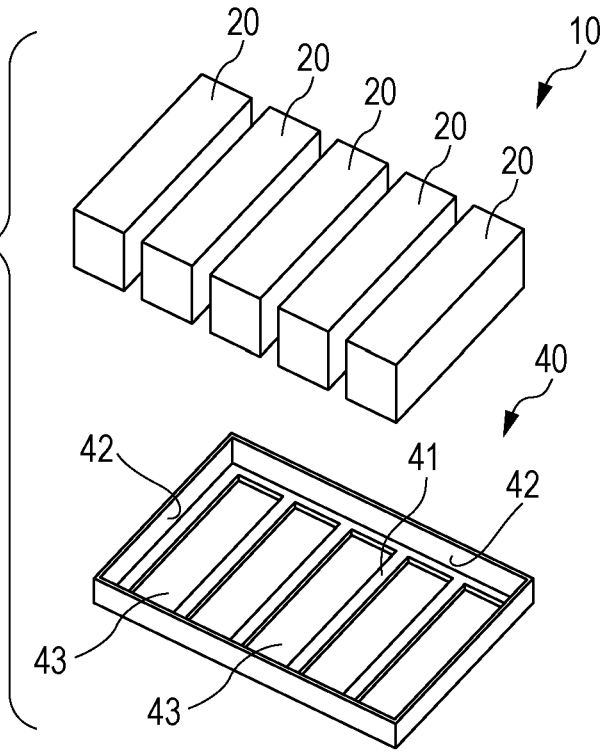
FIG. 2 is a schematic view illustrating an example of a recording head.

Next, the configuration of the recording head 10 will be described below. As shown in FIG. 2, in this embodiment, the recording head 10 is constituted of a plurality of recording head base units 20 (five, for example) and a fixing member 40 to which the plurality of recording head base units 20 are fixed.

Figure 3A:
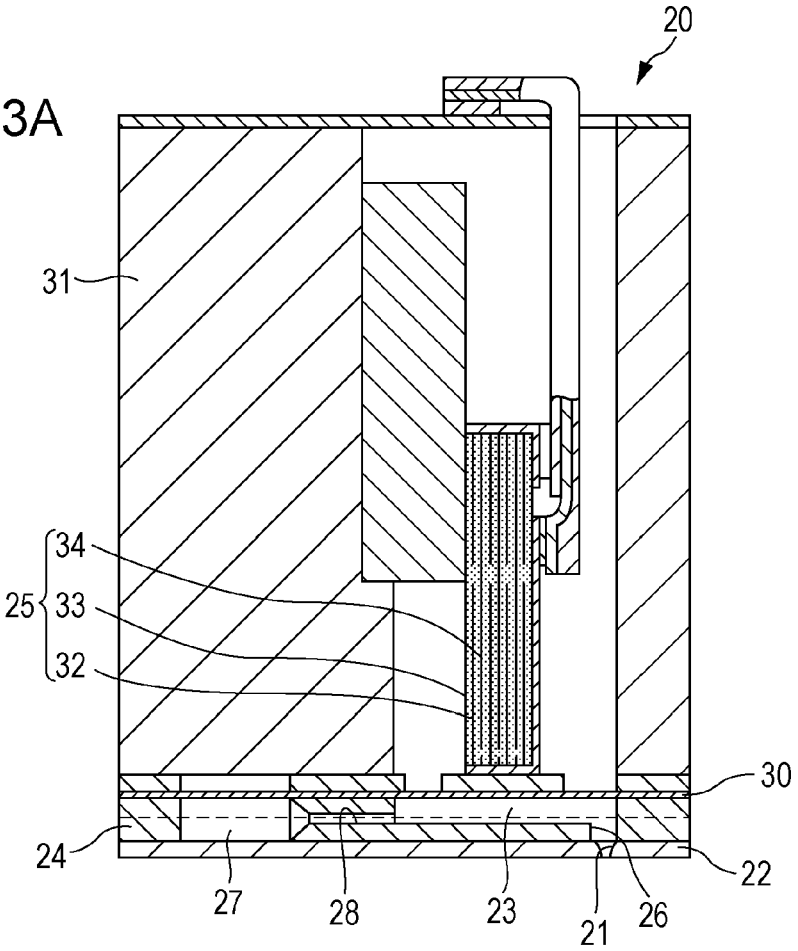
FIGS. 3A and 3B are cross-sectional views illustrating an example of a recording head base unit.
Figure 3B:
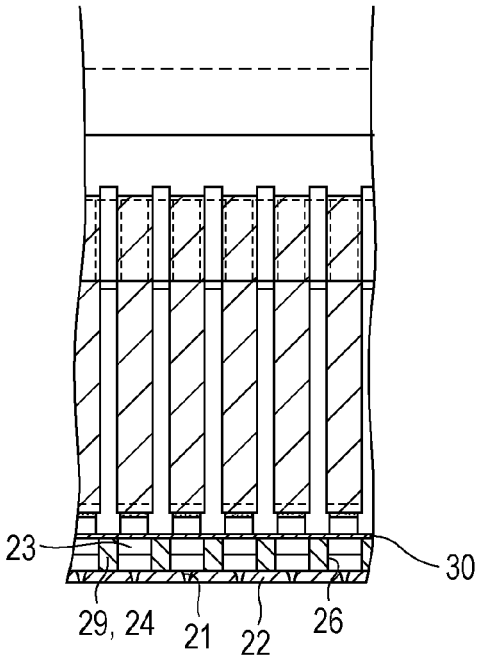

Each recording head base unit 20 includes, as shown in FIGS. 3A and 3B, a nozzle plate 22 in which a plurality of nozzles 21 through which ink droplets are ejected are bored, a flow path formation substrate 24 to one side of which the nozzle plate 22 is bonded and in which a plurality of pressure generation chambers 23 communicating with the nozzles 21 are formed, and piezoelectric elements 25 as pressure generation means that are provided on a surface on the opposite side to the nozzle plate 22 of the flow path formation substrate 24. In this embodiment, along with the pressure generation chambers 23, nozzle communication holes 26, manifolds 27 and ink supply holes 28 are formed in the flow path formation substrate 24. The pressure generation chambers 23 are provided in a surface layer portion at the one side of the flow path formation substrate 24, and defined by separation walls 29 to be arranged in parallel to each other in a width direction of the chamber.

On a surface on the opposite side of the flow path formation substrate 24 to the nozzle plate 22, that is, on an opening surface side of the pressure generation chamber 23, a vibration plate 30 is bonded so that one side of each of the pressure generation chambers 23 is configured by the vibration plate 30. On the upper side of the vibration plate 30, the piezoelectric elements 25 are provided and a head case 31 where the piezoelectric elements 25 are accommodated is fixed. Although the configuration of the piezoelectric element 25 is not limited to any specific one, the piezoelectric element 25 of this embodiment is formed by alternately laminating piezoelectric materials 32 and electrode formation materials 33, 34 in a manner in which those materials are provided longitudinally to be laminated and sandwiched.

The recording head base units 20 having the above configuration are placed at respective predetermined positions, subsequently the nozzle plates 22 are fixed to the fixing member 40 using an adhesive or the like.

As shown in FIG. 2, the fixing member 40 is configured of a bottom surface portion 41 and side walls 42 that are continuously provided along the circumference of the bottom surface portion 41 so as to form a recess for accommodating a part on the nozzle plate 22 side of each of the recording head base units 20. Opening portions 43 are formed in the bottom surface portion 41, each placed at a position opposing each of the recording head base units 20, and each of the recording head base units 20 is fixed to the fixing member 40 in a state in which the nozzles 21 thereof are exposed in the opening portion 43.

The side walls 42 are continuously formed along the circumference of the bottom surface portion 41 in order for a contact section of a close-contact cap member to make contact therewith, details of which will be described later. In other words, all the side walls 42 are integrally formed without any gap. In this embodiment, the fixing member 40 is formed by drawing, for example, in which the bottom surface portion 41 and the side walls 42 configuring four surfaces of the circumference of the bottom surface portion 41 are integrally formed.

The recording apparatus 1 having the recording head 10 of the above configuration includes a capping device 50 for capping an ink ejecting surface (liquid ejecting surface) in which the nozzles 21 of the recording head 10 are opened (see FIG. 1). In this embodiment, because the nozzle plates 22 of the recording head base units 20 constituting the recording head 10 are fixed to the bottom surface portion 41 of the fixing member 40, the bottom surface portion 41 of the fixing member 40 is the ink ejecting surface of the recording head 10.

Figure 4:
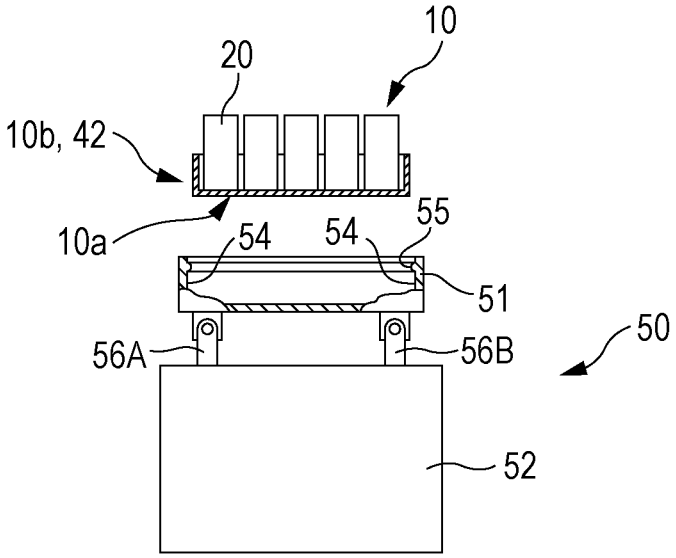
FIG. 4 is a schematic view illustrating a capping device included in the recording apparatus according to the first embodiment of the invention.

The capping device 50 is provided at a position on a lateral side of the platen 8 which is an end of the movement direction of the carriage 2. As shown in FIG. 4, the capping device 50 includes a close-contact cap (cap member) 51 that is attached to the recording head 10 to cap an ink ejecting surface 10*a* and a movement mechanism (movement unit) 52 configured to relatively move the close-contact cap 51 with respect to the recording head 10. In this embodiment, the movement mechanism 52 is so configured as to move the close-contact cap 51 itself. The movement mechanism 52 may be so configured as to relatively move the close-contact cap 51 by moving only the recording head 10 or moving both the recording head 10 and the close-contact cap 51.

Figure 5:
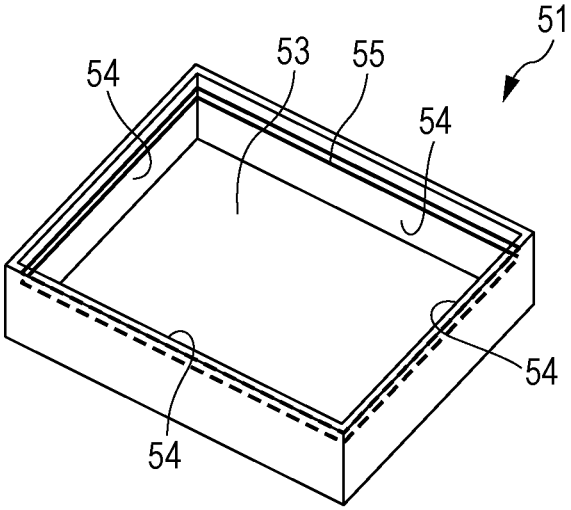
FIG. 5 is a schematic perspective view of a close-contact cap according to the first embodiment of the invention.

As shown in FIG. 5, the close-contact cap 51 has a fitting recess 53 into which the recording head 10 (fixing member 40 in this embodiment) is fitted. On inner surfaces 54 of the fitting recess 53, a contact section 55 projecting toward an inner side of the fitting recess 53 is continuously provided along the whole circumference of the fitting recess 53. In this embodiment, the contact section 55 is provided along an opening surface of the fitting recess 53.

When the recording head 10 is inserted into the fitting recess 53 of the close-contact cap 51, the contact section 55 makes contact with a side surface 10*b* of the recording head 10 which is a surface intersecting with the ink ejecting surface 10*a*. Details of this will be described later. In this embodiment, the contact section 55 makes contact with the side walls 42 of the fixing member 40 constituting the recording head 10. Through this, the ink ejecting surface 10*a* of the recording head 10 is capped within the close-contact cap 51. Although a material used for forming the contact section 55 is not limited to any specific one, an elastic material such as rubber is used in this embodiment so as for the contact section 55 to make contact with the recording head 10 with certainty and to prevent the surface of the recording head 10 from being damaged.

The movement mechanism 52 is so configured as to move the close-contact cap 51 in a manner in which an area on the side surface 10*b* of the recording head 10 with which the contact section 55 makes contact is gradually increased when attaching the close-contact cap 51 to the recording head 10. In this embodiment, the movement mechanism 52 is configured so that, when the close-contact cap 51 is attached to the recording head 10, the recording head 10 is fitted into the fitting recess 53 of the close-contact cap 51 in a state in which the close-contact cap 51 is made to be slanted at a predetermined angle relative to the ink ejecting surface 10*a* and subsequently the close-contact cap 51 is so moved (rotated) as to be substantially parallel with the ink ejecting surface 10*a*. More specifically, the movement mechanism 52 includes: a pair of coupling members 56A and 56B one end side of which is connected to the close-contact cap 51; and an elevating movement unit (not shown) that has a driving source such as a motor, for example, and raises/lowers the coupling members 56A and 56B separately as well as moves them in a horizontal direction. The coupling members 56A and 56B are rotatably coupled to the vicinities of diagonal portions of the close-contact cap 51 in a parallel alignment direction of the recording head base units 20, for example. In this embodiment, the coupling members 56A and 56B are coupled to the close-contact cap 51 having small play.

Operation of the capping device 50 provided with the above close-contact cap 51 and movement mechanism 52 will be described below.

Figure 6A:
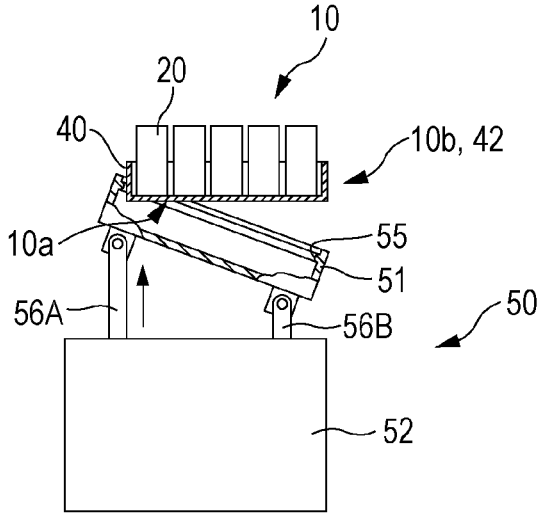
FIGS. 6A through 6C are schematic views illustrating operation of the capping device according to the first embodiment of the invention.
Figure 6B:
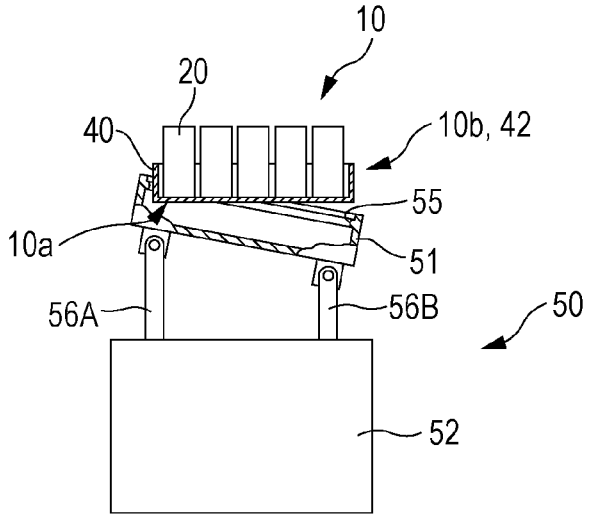

When capping is performed, the recording head 10 is placed first at a predetermined position opposing the close-contact cap 51 (see FIG. 4). That is, the carriage 2 on which the recording head 10 is mounted is moved to the predetermined position along the carriage shaft 5. In the above state, as shown in FIG. 6A, the movement mechanism 52 raises the coupling member 56A, which is one of the paired coupling members, to a predetermined position. In reality, the coupling member 56A is slightly moved in the horizontal direction toward the coupling member 56B side while being raised. Through this, the close-contact cap 51 is raised with the opening surface of the fitting recess 53 being slanted, so that part of the recording head 10 is inserted into the fitting recess 53 of the close-contact cap 51. Subsequently, part of the contact section 55 is caused to make contact with the side surface 10*b* of the recording head 10, that is, make contact with the side wall 42 of the fixing member 40 in this embodiment.

At this time, it is preferable to slightly move the close-contact cap 51 to the coupling member 56B side or slightly move the recording head 10 to the coupling member 56A side, for example, so as to stretch and extend the close-contact cap 51 while the close-contact cap 51 being in contact with the side surface 10*b* at one side of the recording head 10.

Figure 6C:
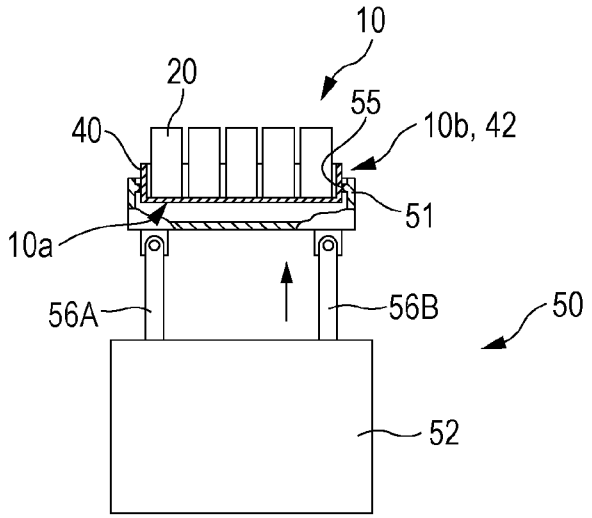

In the above state, the coupling member 56B is raised, as shown in FIG. 6C. Through this, while an area on the side surface 10*b* of the recording head 10 with which the contact section 55 makes contact is gradually increased, the whole recording head 10 is inserted into the close-contact cap 51. After the insertion of the whole recording head 10, if the close-contact cap 51 is being stretched and extended, the stretching and extending is released so that the close-contact cap 51 is attached to the recording head 10. In other words, the contact section 55 makes contact with the side surface 10*b* of the recording head 10 along the circumferential direction thereof so that the ink ejecting surface 10*a* of the recording head 10 is capped within the close-contact cap 51.

In this embodiment, as described above, the close-contact cap 51 attached to the recording head 10 is held with the contact section 55 being in contact with the side surface 10*b* of the recording head 10. Accordingly, the magnitude of stress produced in the nozzle plate 22 in a direction in which the nozzle plate 22 is separated from the flow path formation substrate 24 is made smaller. This makes it possible to suppress the separation of the nozzle plate 22.

Further, when the close-contact cap 51 is attached to the recording head 10, the close-contact cap 51 is rotated from a state in which the close-contact cap 51 is slanted and in contact with the side surface of the recording head 10 so as to gradually increase the area on the side surface 10*b* of the recording head 10 with which the contact section 55 makes contact. That is to say, friction force produced due to the contact section 55 making contact with the recording head 10 is made to gradually increase. This makes it possible to smoothly attach the close-contact cap 51 while suppressing a force applied to the upper side of the recording head 10. In particular, as described above, by stretching and extending the close-contact cap 51 at the time when the close-contact cap 51 is attached to the recording head 10, it is possible to attach the close-contact cap 51 to the recording head 10 more smoothly.

Second Embodiment

Figure 7:
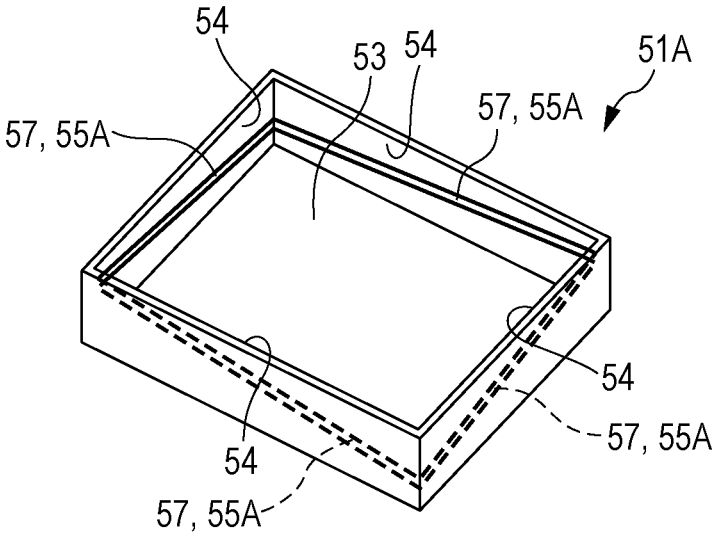
FIG. 7 is a schematic perspective view of a close-contact cap according to a second embodiment of the invention.

FIG. 7 is a view illustrating a general configuration of a capping device included in a recording apparatus according to a second embodiment of the invention. It is to be noted that like members are referenced by like reference numerals and duplicate descriptions thereof will be omitted herein.

A contact section 55A provided in a close-contact cap 51A according to this embodiment is configured of slope portions 57 that are sloped with respect to an opening surface of the close-contact cap 51A. To be more specific, as shown in FIG. 7, the contact section 55A is provided being sloped in one direction at each of the four inner surfaces 54, and is continuously provided along the circumferential direction of the fitting recess 53. In other words, the contact section 55A is configured by continuing the slope portions 57 provided on the inner surfaces 54.

Figure 8:
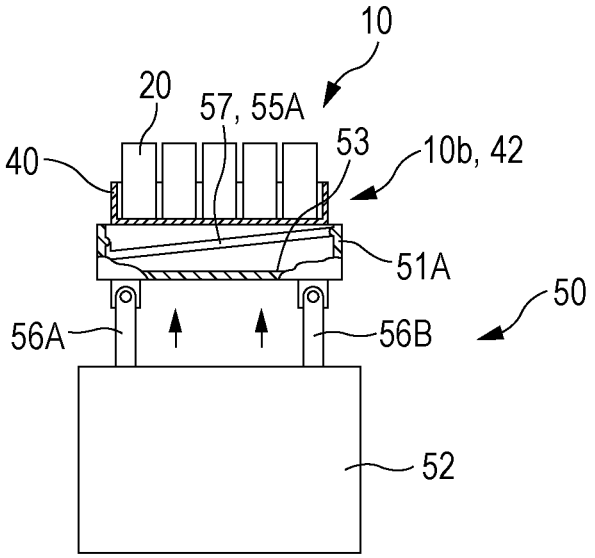
FIG. 8 is a schematic view illustrating operation of a capping device according to the second embodiment of the invention.

As shown in FIG. 8, the movement mechanism 52 according to this embodiment, when attaching the close-contact cap 51A to the recording head 10, raises the close-contact cap 51A without being slanted. In other words, the coupling members 56A and 56B are raised simultaneously so as to attach the close-contact cap 51A to the recording head 10. At this time, it is preferable for the movement mechanism 52 to slightly move the close-contact cap 51A to the coupling member 56B side or slightly move the recording head 10 to the coupling member 56A side, for example, so as to stretch and extend the close-contact cap 51A while the close-contact cap 51A being in contact with the side surface 10*b* at one side of the recording head 10.

As described above, because the contact section 55A is configured of the slope portions 57, an area on the side surface 10*b* of the recording head 10 with which the contact section 55A makes contact is gradually increased even if the close-contact cap 51A is raised without being slanted. Accordingly, it is possible to smoothly attach the close-contact cap 51A to the recording head 10 and suppress the separation of the nozzle plate.

Figure 9:
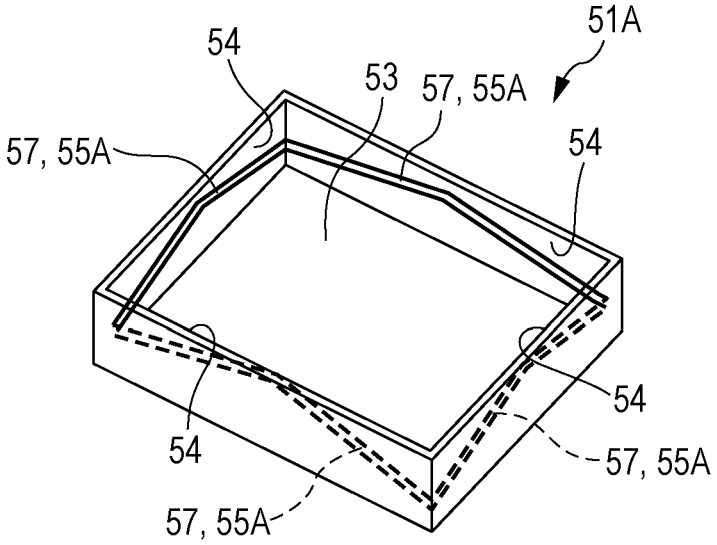
FIG. 9 is a schematic perspective view illustrating a variation on the close-contact cap according to the second embodiment of the invention.

Although the configuration in which each slope portion 57 is provided being sloped in one direction at each of the inner surfaces 54 is exemplified in this embodiment, the configuration of the slope portion 57 is not limited thereto. The slope portion 57 may be provided being sloped in two directions, for example. More specifically, as shown in FIG. 9, the slope portions 57 on the respective inner surfaces 54 may be formed in a mountain shape projecting toward the opening side of the fitting recess 53. Because the contact section 55A is configured of such slope portions 57, the close-contact cap 51A can be more smoothly attached to the recording head 10.

Although the example in which the contact section 55A is configured of only the slope portions 57 is described in this embodiment, only a part of the contact section 55A may be configured of the slope portions 57.

Thus far, the embodiments of this invention have been described. However, the invention is not limited to the above embodiments.

For example, in the above embodiments, the close-contact cap is moved by the movement mechanism having two coupling members; however, the configuration of the movement mechanism is not limited thereto. Further, in the above embodiments, although the movement mechanism 52 moves the close-contact cap 51 itself, the movement mechanism 52 may move the recording head 10 instead of the close-contact cap 51 so that the close-contact cap 51 is relatively moved with respect to the recording head 10 as a result. It is needless to say that the movement mechanism 52 may be so configured as to move the close-contact cap 51 and the recording head 10, respectively.

In the above embodiments, an example of the recording head 10 is described. However, the configuration of the recording head 10 is not limited to any specific one, and configurations of the known techniques can be appropriately employed in the recording head 10.

What is claimed is:

1. A liquid ejecting apparatus comprising:

a liquid ejecting head having a nozzle plate provided with a nozzle through which liquid is ejected;

a cap member that is attached to the liquid ejecting head to cap a liquid ejecting surface in which the nozzle is opened; and a movement unit that relatively moves at least one of the cap member and the liquid ejecting head, wherein the cap member includes a recess in which the liquid ejecting head is mounted, and on inner surfaces of the recess, a contact section that makes contact with a side surface of the liquid ejecting head intersecting with the liquid ejecting surface is continuously provided along a circumferential direction of the recess, and the movement unit is so configured as to move the cap member relative to the liquid ejecting head in a manner in which an area on the side surface of the liquid ejecting head with which the contact section makes contact is gradually increased when attaching the cap member to the liquid ejecting head, wherein the movement unit is configured so that, when the cap member is attached to the liquid ejecting head, the liquid ejecting head is fitted in the recess of the cap member in a state in which the cap member is made to be slanted at a predetermined angle relative to the liquid ejecting surface and subsequently the cap member is so rotated as to be parallel with the liquid ejecting surface.

2. The liquid ejecting apparatus according to claim 1, wherein the movement unit is so configured as to move the cap member along the liquid ejecting surface in a state in which the liquid ejecting head is fitted in the recess of the cap member.

3. The liquid ejecting apparatus according to claim 1, wherein the movement unit is so configured as to move the cap member along the liquid ejecting surface in a manner in which the cap member is stretched and extended while the cap member being in contact with the side surface at one side of the liquid ejecting head.

4. The liquid ejecting apparatus according to claim 3, wherein the movement unit releases the stretching and extending of the cap member after the liquid ejecting head has been inserted into the cap member.

5. The liquid ejecting apparatus according to claim 1, wherein the movement unit includes a pair of coupling members coupled to the cap member in a rotatable manner, and an elevating movement unit configured to raise/lower the coupling members separately.

6. The liquid ejecting apparatus according to claim 1, wherein the contact section includes a slope portion that is sloped with respect to a bottom surface of the cap member.

7. The liquid ejecting apparatus according to claim 6, wherein the contact section includes the slope portions on the respective inner surfaces configuring the recess of the cap member, and the slope portions are formed in a mountain shape projecting toward an opening side of the recess.

8. The liquid ejecting apparatus according to claim 1, wherein the movement unit attaches the cap member to the liquid ejecting head by moving the liquid ejecting head.

9. The liquid ejecting apparatus according to claim 1, wherein the liquid ejecting head includes the nozzle plate provided with the nozzle and a fixing member fixed with the nozzle plate, the fixing member includes an opening portion for opening the nozzle and side walls that are continuously provided along a circumference of the opening portion, and the movement unit attaches the cap member to the liquid ejecting head by causing the contact section to make contact with the side wall.

10. A method of attaching a cap member to a liquid ejecting head of a liquid ejecting apparatus that includes a movement unit, the method comprising:

causing a contact section of the cap member to make contact with a side surface of the liquid ejecting head with the cap member being slanted at a predetermined angle relative to a liquid ejecting surface by relatively moving at least one of the cap member and the liquid ejecting head using the movement unit;

gradually increasing an area where the contact is made by relatively moving and rotating at least one of the cap member and the liquid ejecting head using the movement unit; and attaching the cap member to the liquid ejecting head.

11. A liquid ejecting apparatus comprising:

a liquid ejecting head having a nozzle plate provided with a nozzle through which liquid is ejected;

a cap member that is attached to the liquid ejecting head to cap a liquid ejecting surface in which the nozzle is opened; and a movement unit that relatively moves at least one of the cap member and the liquid ejecting head, wherein the cap member includes a recess in which the liquid ejecting head is mounted, and on inner surfaces of the recess, a contact section that makes contact with a side surface of the liquid ejecting head intersecting with the liquid ejecting surface is continuously provided along a circumferential direction of the recess, and the movement unit is so configured as to move the cap member relative to the liquid ejecting head in a manner in which an area on the side surface of the liquid ejecting head with which the contact section makes contact is gradually increased when attaching the cap member to the liquid ejecting head, wherein the movement unit is so configured as to move the cap member along the liquid ejecting surface in a manner in which the cap member is stretched and extended while the cap member being in contact with the side surface at one side of the liquid ejecting head.

12. The liquid ejecting apparatus according to claim 11, wherein the movement unit releases the stretching and extending of the cap member after the liquid ejecting head has been inserted into the cap member.

13. The liquid ejecting apparatus according to claim 11, wherein the movement unit includes a pair of coupling members coupled to the cap member in a rotatable manner, and an elevating movement unit configured to raise/lower the coupling members separately.

14. The liquid ejecting apparatus according to claim 11, wherein the contact section includes a slope portion that is sloped with respect to a bottom surface of the cap member.

15. The liquid ejecting apparatus according to claim 14, wherein the contact section includes the slope portions on the respective inner surfaces configuring the recess of the cap member, and the slope portions are formed in a mountain shape projecting toward an opening side of the recess.

16. A liquid ejecting apparatus comprising:

a liquid ejecting head having a nozzle plate provided with a nozzle through which liquid is ejected;

a cap member that is attached to the liquid ejecting head to cap a liquid ejecting surface in which the nozzle is opened; and a movement unit that relatively moves at least one of the cap member and the liquid ejecting head, wherein the cap member includes a recess in which the liquid ejecting head is mounted, and on inner surfaces of the recess, a contact section that makes contact with a side surface of the liquid ejecting head intersecting with the liquid ejecting surface is continuously provided along a circumferential direction of the recess, and the movement unit is so configured as to move the cap member relative to the liquid ejecting head in a manner in which an area on the side surface of the liquid ejecting head with which the contact section makes contact is gradually increased when attaching the cap member to the liquid ejecting head, wherein the movement unit includes a pair of coupling members coupled to the cap member in a rotatable manner, and an elevating movement unit configured to raise/lower the coupling members separately.

17. The liquid ejecting apparatus according to claim 16, wherein the contact section includes a slope portion that is sloped with respect to a bottom surface of the cap member.

18. The liquid ejecting apparatus according to claim 16, wherein the contact section includes the slope portions on the respective inner surfaces configuring the recess of the cap member, and the slope portions are formed in a mountain shape projecting toward an opening side of the recess.

* * * * *